US005640156A

United States Patent [19]

Okuda et al.

[11] Patent Number: 5,640,156

[45] Date of Patent: Jun. 17, 1997

[54] MOBILE COMMUNICATION METHOD

[75] Inventors: Takehiko Okuda, Ogaki; Koichi Yagi, Toyota, both of Japan

[73] Assignee: Toyota Jidosha Kabushiki Kaisha, Tokyota, Japan

[21] Appl. No.: 551,735

[22] Filed: Nov. 1, 1995

[30] Foreign Application Priority Data

Nov. 2, 1994 [JP] Japan ..... 6-270015
Apr. 28, 1995 [JP] Japan ..... 7-104503

[51] Int. Cl.[6] ..... G08G 1/00

[52] U.S. Cl. ..... 340/928; 340/933; 340/937; 235/384; 455/54.1

[58] Field of Search ..... 340/933, 928, 340/942, 937, 825.34, 825.31, 825.69, 825.54; 364/401; 342/42, 44, 50, 51; 235/384, 380, 379; 380/23, 24; 455/54.1, 54.2, 33.1

[56] References Cited

U.S. PATENT DOCUMENTS 4,303,904 12/1981 Chasek ..... 340/825.54
5,086,389 2/1992 Hassett et al. ..... 340/928
5,310,999 5/1994 Claus et al. ..... 235/384
5,485,520 1/1996 Chaum et al. ..... 340/825.34

FOREIGN PATENT DOCUMENTS 0401192 12/1990 European Pat. Off. .
616 302 9/1994 European Pat. Off. .
3-189798 8/1991 Japan .
6-243385 9/1994 Japan .
6-243316 9/1994 Japan .

*Primary Examiner*—Jeffery Hofsass
*Assistant Examiner*—Daniel J. Wu
*Attorney, Agent, or Firm*—Cushman, Darby & Cushman IP Group of Pillsbury, Madison & Sutro LLP

[57] ABSTRACT

A mobile communication method wherein a pilot signal is repeatedly transmitted toward a communication zone. As an IU on a vehicle arrives at the communication zone, it transmits a pilot response signal in reply to the pilot signal. When the confirmation antenna receives the pilot response signal, a procedure relating to the confirmation of debiting is executed. When a given time period has passed after this procedure has terminated, the IU transmits an existence-in-second-gantry-zone signal in response to the pilot signal, if the vehicle still exists in the communication zone. By receiving the existence-in-second-gantry-zone signal, it can be ascertained that the vehicle having a confirmed debiting associated therewith exists in the communication zone. Even if a plurality of vehicles are running in the same lane side-by-side, each of these vehicles can be distinguished from one another. The mobile communication method may be similarly applied to any other moving body, as well as to a road vehicle.

7 Claims, 10 Drawing Sheets

MOBILE COMMUNICATION METHOD

BACKGROUND OF THE INVENTION a) Field of the Invention

The present invention relates to a mobile communication method for communicating between a fixed station and a mobile station installed on a movable object.

b) Description of the Prior Art

The conventional method for debiting vehicles on toll roads and the like is an exclusively manual method in which an attendant manually receives a toll from each of the vehicles passing through the gate. Such a method is disadvantageous in that attendants must be employed, it causes a traffic jam depending on the number or flow of passing vehicles, and so on. To overcome such problems, many debiting systems have been developed which utilize various types of remote sensing techniques and radio communication techniques.

For example, Japanese Patent Laid-Open No. Hei 3-189798 disclose a system that uses ID plates, each of which is applied to a vehicle to be debited and stores the vehicle number and the balance of a contract or number of times the plate was accessed. An ID plate reader including an road antenna and a camera is located at a given point on the road (e.g., at a toll gate). The ID plate reader is adapted to carry out radio communication between the ID plate reader and the ID plate on a vehicle through the road antenna while capturing the license plate of that vehicle through the camera. The ID plate reader compares and checks the information of the vehicle number obtained through the radio communication with the information of the vehicle number obtained by image processing the captured image. If both sets of information coincide, the ID plate reader determines that the ID plate is properly used by the actual user.

However, such a system can properly function only when a single vehicle exists near the ID plate reader. Suppose that this system is applied to a single-lane road with a single ID plate reader being provided for the single road lane. If a plurality of motorbikes are moving on the single road lane side by side, a motorbike communicating with the ID plate reader is not necessarily coincident with a motorbike having its license plate captured by the camera of the ID plate reader. Even if any one of the motorbikes running side by side improperly uses the ID plate, therefore, the plate cannot be precisely detected.

SUMMARY OF THE INVENTION

The first object of the present invention is to provide a system that can distinguish a moving body, which has terminated communication of information relating to the debit or the like, from another moving body which has not terminated communication, even if a plurality of moving bodies are simultaneously running on the same road when the radio communication takes place between a fixed station located adjacent to the road and mobile stations installed on the moving bodies on the road. This object is accomplished by improving the process relating to the response from the moving bodies.

In the first aspect of the present invention, there is provided a mobile communication method for performing radio communication between a fixed station disposed adjacent to a road on which a plurality of moving bodies are moving and mobile stations respectively installed on the moving bodies moving on the road, the method comprising a first step of repeatedly and wirelessly transmitting a solicitation signal for soliciting communication of information from the fixed station toward a communication zone; a second step of wirelessly transmitting from the mobile station a first response indicating a willingness to participate in the communication of the information and a second response indicating that the information has already been communicated from the mobile stations existing in the communication zone in response to the solicitation signal, the first response being transmitted from a mobile station which has not participated in the communication yet, the second response being transmitted from a mobile station which has already participated in the communication; and a third step of wirelessly communicating between the fixed station which transmitted the solicitation signal and the mobile station which transmitted the first response. Thus, the fixed station can distinguish the mobile stations which have already participated to the information communication (debit confirmation and others) from the other mobile stations which have not yet participated to the information communication. Even if a plurality of moving bodies are moving on the same road side-by-side, therefore, the moving bodies can be individually distinguished from each other.

In a second aspect of the present invention, the mobile communication method of the first aspect is further characterized by the fact that the second step includes a step of causing any mobile station that previously communicated the information, among the mobile stations existing in the communication zone, to wirelessly transmit the second response in reply to the solicitation signal only when a given time period has passed after the communication of the information has terminated. According to this aspect, the frequency of communication between the fixed station will be suppressed and therefore the communication traffic is reduced. Even if a number of moving bodies exist near the fixed station at the same time, the transmission of signals from mobile stations that have already participated in the transaction can be prevented from obstructing the transmission of signals from a mobile station that has not yet participated.

In a third aspect of the present invention, the mobile communication method of the first aspect further comprises a fourth step of causing the fixed station to detect times at which the first and second response are received by the fixed station; a fifth step of causing the fixed station to detect that a moving body has passed through a given point on the road and a time at which this occurs, in parallel to the execution of the first to fourth steps; and a sixth step of causing the fixed station to detect a moving body having a mobile station that did not exactly execute the second step from among the moving bodies whose passage is detected at the fifth step, by matching the time of reception detected at the fourth step with the time of passage detected at the fifth step. According to the third aspect, the moving body which has passed through a particular point on the road can be reliably specified by utilizing the detected time of passage of the moving body, in addition to the condition of communication between the fixed station and the mobile stations.

In a fourth aspect of the present invention, the mobile communication method of the second aspect is further characterized by the fact that in addition to the fourth to sixth steps according to the third aspect, the method further comprises a seventh step of, prior to the sixth step, excluding selective ones of the first and second responses from the matching of the sixth step, the selective ones being first and second responses whose time of reception has been detected in the fourth step as not being later than the given time period that has been passed after the time of passage detected at the fifth step. According to the fourth aspect the moving body which has passed through a particular point on the road can be exactly specified.

In the fifth aspect of the present invention, the mobile communication method of the fourth aspect is further characterized by the fact that the seventh step comprises a step of, prior to the sixth step, excluding the first and second responses from the matching of the sixth step if the time of receiving the responses sensed at the fourth step is after the time of passage sensed at the fifth step and before said given time period plus a given margin time period has passed. According to the fifth aspect even if an error occurs in the detected time of passage of the moving body and the time of reception of the first and second responses. The specification of the moving bodies can be accurately executed.

In the sixth aspect of the present invention, the mobile communication method of the third or fourth aspect are further characterized by the fact that the given point is in the communication zone. According to the sixth aspect, the mobile communication method can deal with a case in which a moving body that does not exactly respond to the second step is running together with another moving body that does exactly respond to the second step. According to the sixth aspect, the mobile communication method can distinguish these moving bodies from each other.

DETAILED DESCRIPTION OF THE PREFERRED EMBODIMENTS

Some preferred embodiments of the present invention will now be described with reference to the drawings.

Figure 1:
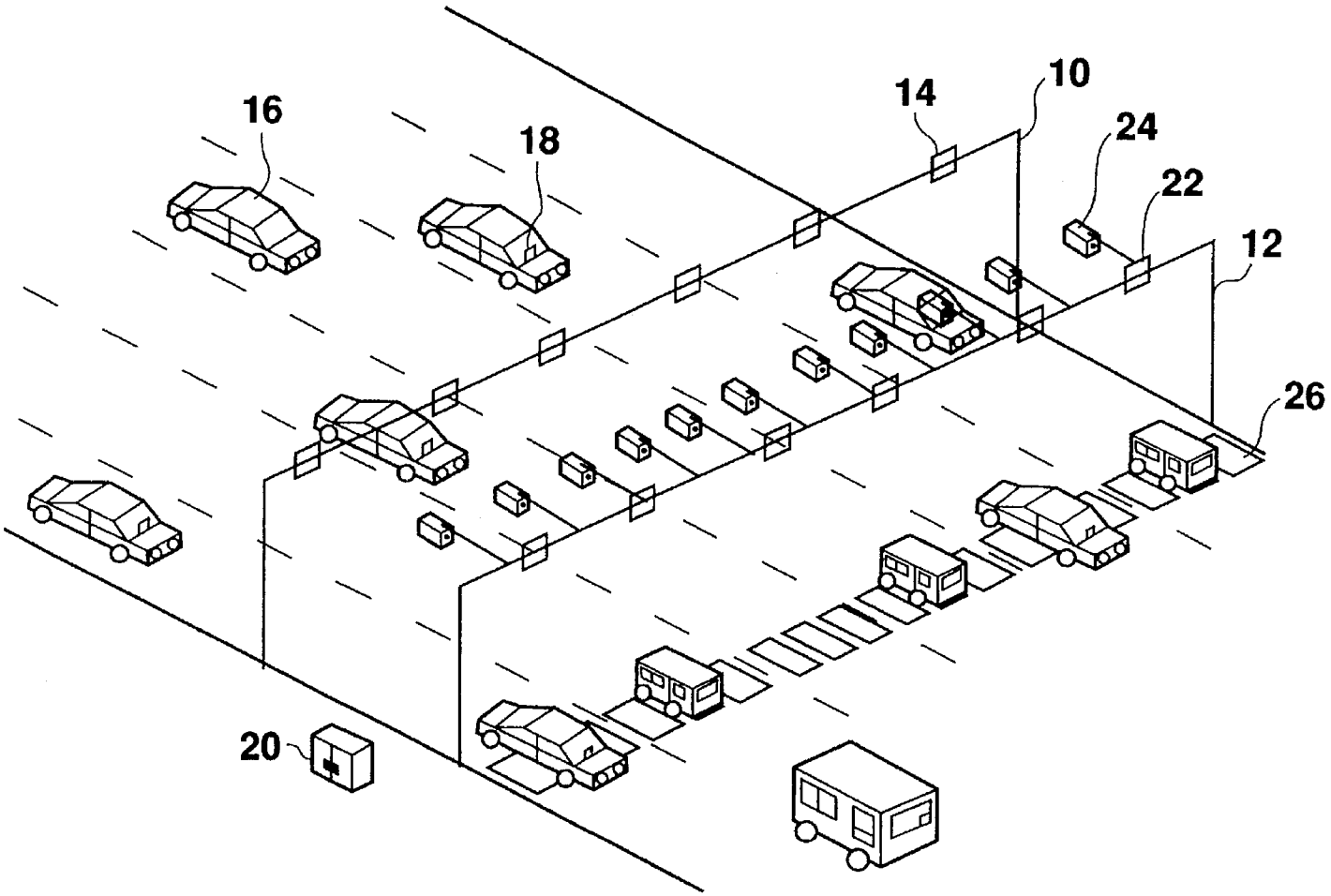
FIG. 1 is an illustration of the first embodiment of the present invention.

FIG. 1 shows the outline of a system relating to the first embodiment of the present invention. In this figure, there are shown first and second gantries 10 and 12 bridging across a six-lane road on which the vehicles 16 are traveling. The first gantry 10 is located upstream of the second gantry 12 in the vehicle flow direction. At the top of the first gantry 10, six debiting antennas 14 are provided corresponding to the respective lanes. On the other hand, each of the vehicles running on the road contains an in-vehicle unit (IU) 18. A local controller 20 is provided adjacent to the road and executes a radio communication between the local controller 20 and the IU 18 located in the communication zone covered by respective ones of the debiting antennas 14 using each of the debiting antennas 14. To perform the communication before the vehicle 16 passes the first gantry 10, the communication zone covered by each of the debiting antennas 14 is located on the corresponding lane upstream of the first gantry 10. In other words, an area located upstream of the first gantry 10 and having a given spread is covered by all of the six debiting antennas 14.

The second gantry 12 is located downstream of the first gantry 10. At the top of the second gantry 12, six confirmation antennas 22 are located corresponding to the respective lanes. The local controller 20 2 executes a communication between the local controller 20 and the IU 18 existing in the communication zone covered by respective ones of confirmation antennas 22, using each of the confirmation antennas 22. To perform the communication before the vehicle 16 passes the second gantry 12, the communication zone covered by each of the confirmation antennas 22 is located on the corresponding lane and upstream of the second gantry 12. In other words, an area located upstream of the second gantry 12 and having a given spread is covered by all of the six confirmation antennas 22.

At the top of the second gantry 12, enforcement cameras 24 are also provided. Each of the enforcement cameras 24 is disposed at an angle such that it can capture the license plate of a vehicle 16 subsequently moving from the communication zones covered by any one of confirmation antennas 22. A given number of vehicle detectors 26 for detecting the passage of the vehicles 16 and the speed thereof are embedded in the road at points downstream of the second gantry 12. The vehicle detectors 26 may be implemented by loop coils whose inductances change in accordance with a magnetic mass passing therearound.

The local controller 20 controls the operations of the aforementioned units, the resulting information being then transmitted to a host controller (not shown).

Figure 2:
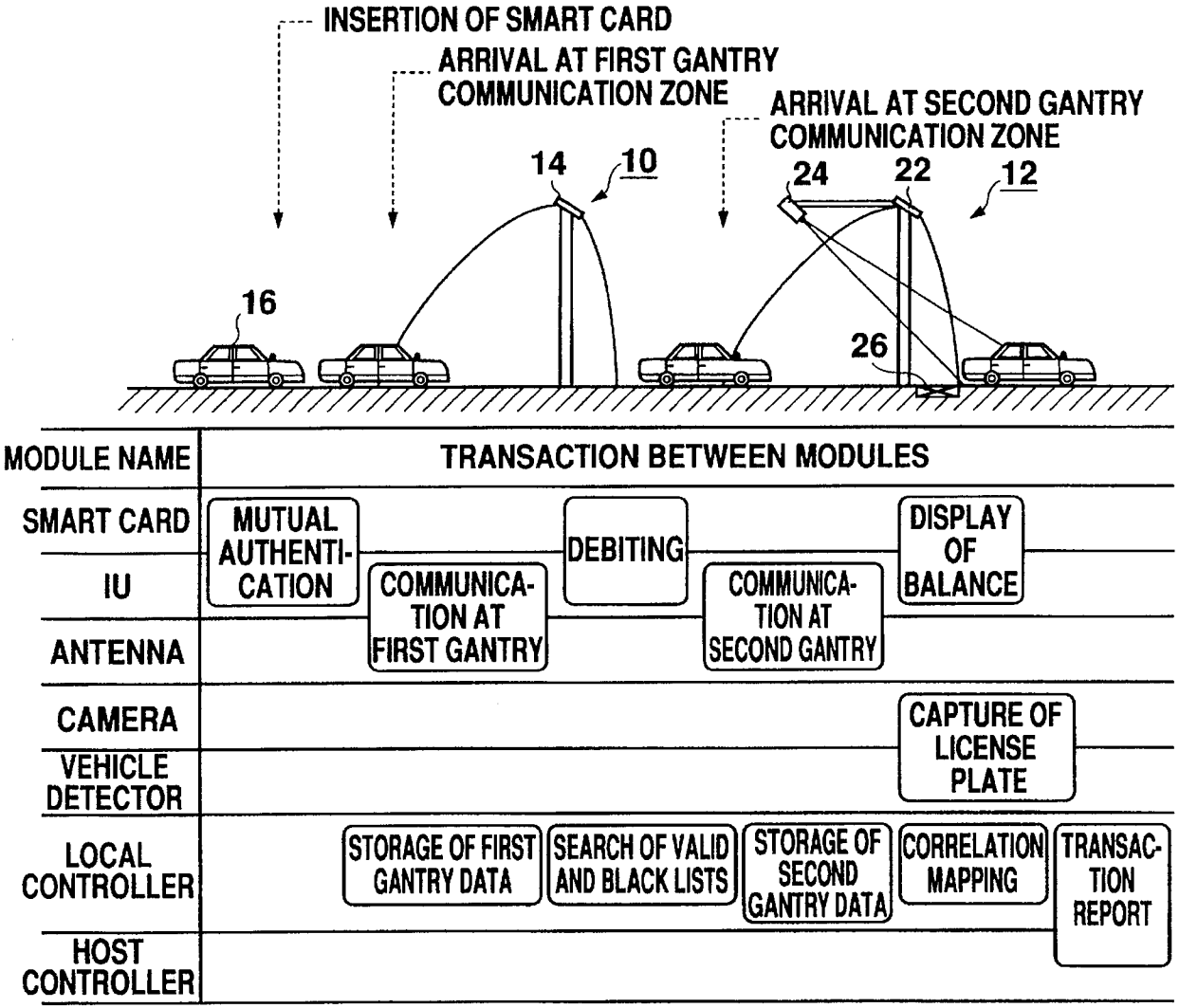
FIG. 2 is a timing chart illustrating a procedure of debiting according to the first embodiment.
Figure 3:
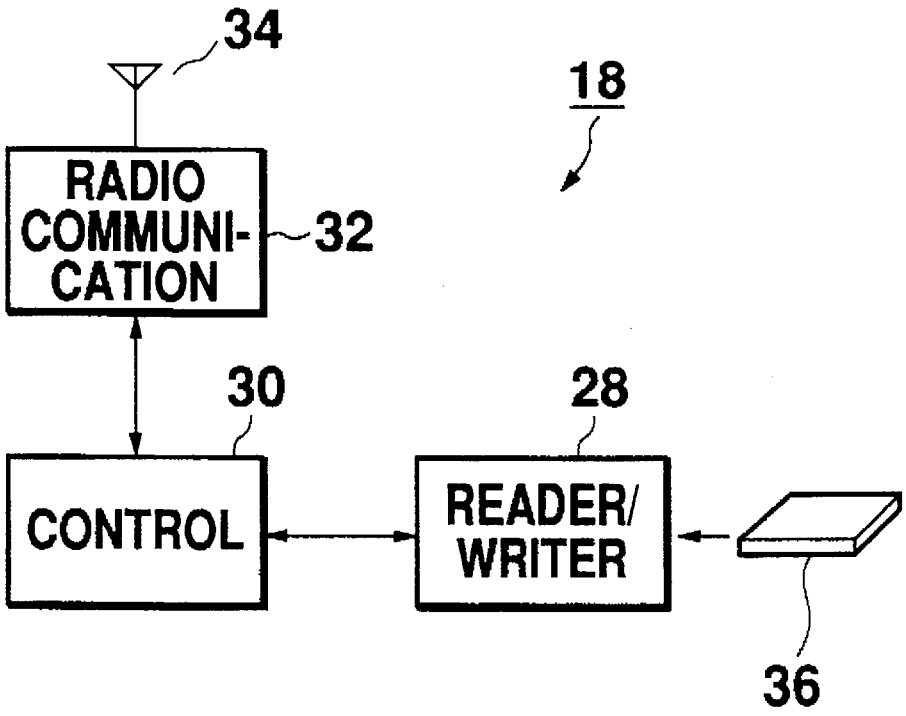
FIG. 3 is a block diagram illustrating the functional structure of an IU.

FIG. 2 schematically shows the procedure for debiting which is accomplished by the first embodiment. The details of the respective units are described in U.S. patent application Ser. No. 08/420687 which has been filed by the same assignee and is hereby incorporated by reference into the present application. As a smart card is inserted into the IU 18 mounted on a vehicle 16, a procedure called "mutual authentication" is executed between the IU 18 and the smart card. The smart card is a kind of IC card which has stored therein the identification information, balance information and other information. As shown in FIG. 3, the IU 18 comprises a reader/writer 28, a control unit 30, a radio communication unit 32 and an antenna 34. As the smart card 36 is inserted into the reader/writer 28, the control unit 30 is responsive to this insertion for executing the procedure of mutual authentication. The control unit 30 also has a function of executing the other control procedures in the IU 18.

Figure 4:
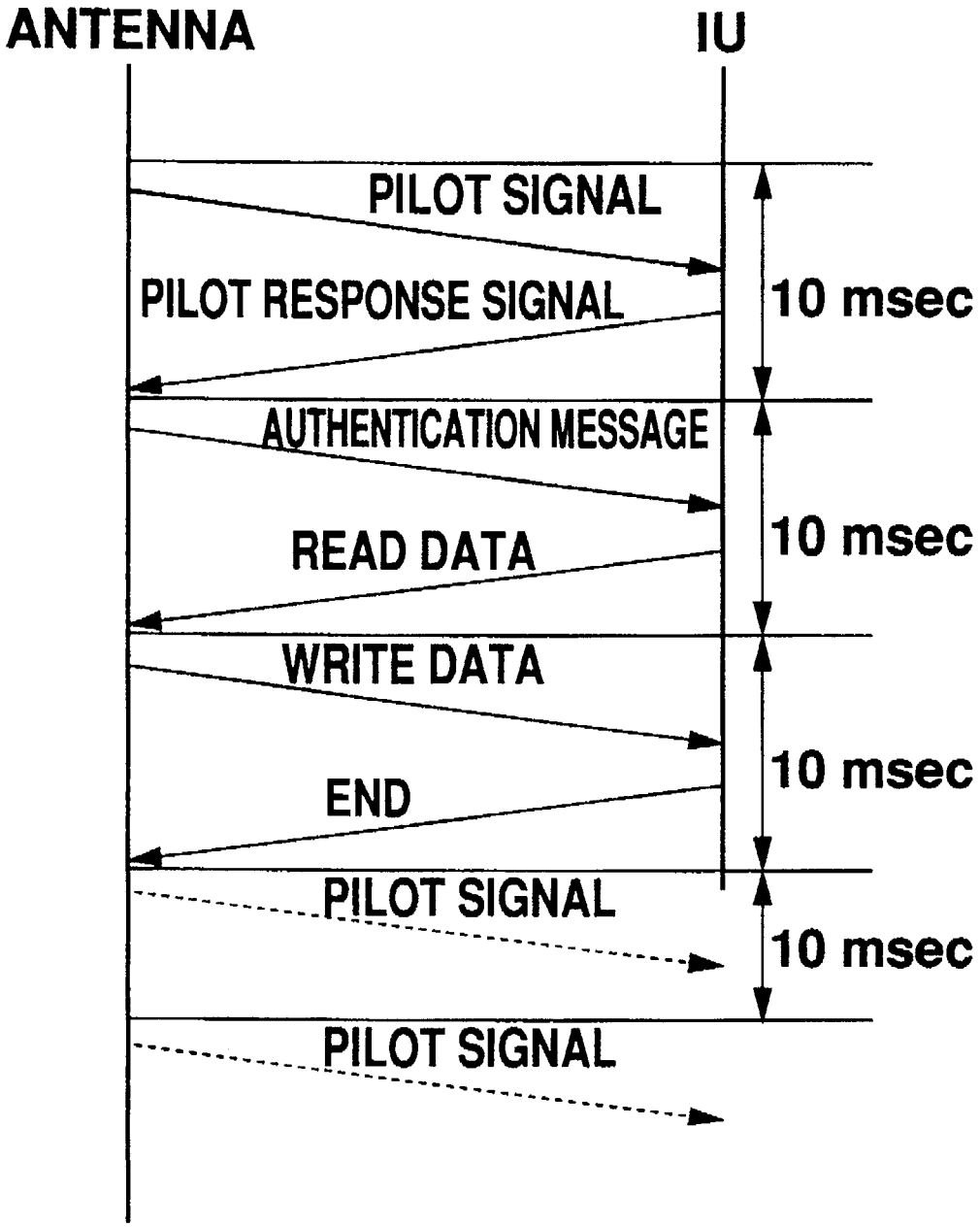
FIG. 4 is a diagram illustrating the procedure of communication in a first gantry communication zone.

When the vehicle 16 in which the mutual authentication has been executed between the IU 18 and the smart card 36 arrives at one of the communication zone covered by the debiting antennas 14 ("first gantry communication zone" shown in FIG. 2), the radio communication is executed between the IU 18 and the local controller 20 through the debiting antenna 14 corresponding to the zone, according to such a procedure as shown in FIG. 4. As will be apparent from FIG. 4, the local controller 20 repeatedly transmits a pilot signal through the debiting antenna 14 in a given cycle. The repeat cycle depends on the maximum running speed expected on that road, the area of the communication zone covered by the antennas and the number of vehicles that can pass through the communication zone at the same time. For example, the repeat cycle may be set to 10 msec. Each of the IU's 18 now existing in the communication zone covered by the debiting antennas 14 transmits a pilot response signal immediately when it first receives the pilot signal through the antenna 34 and radio communication unit 32.

As the local controller 20 receives the pilot response signal through any one of the debiting antennas 14, the former then transmits an authentication message (e.g., secret number) through the corresponding debiting antenna 14 in the next repeat cycle. After the corresponding IU 18 has received the authentication message, it reads the information of balance or the like from the smart card 36 and then wirelessly transmits the read data (e.g., read balance information with a secret number) through the antenna 34 of that IU 18. As the local controller 20 receives the data from the IU 18 through the debiting antenna 14, the former again transmits write data (e.g., fee information with a secret number) through the debiting antenna 14 in the next repeat cycle. After receiving the write data, the IU 18 transmits an end signal. Thereafter, the IU 18 will not response to the pilot signal transmitted from the same or other debiting antenna 14 on the same first gantry 10.

IU 18 is responsive to the received write data for executing the writing step to the smart card 36 such that the debited fee will be deducted out from the smart card 36 (debiting). The local controller 20 writes information representing whether or not the communication relating to the debiting was properly performed, information indicating times of that communication (times at which the signals from the IU 18 were received) and other information in an internal data base. The local controller 20 also searches whether or not an IU 18 now communicating therewith is registered in a list of IU's 18 now available (valid list) and/or a list of IU's used by persons prohibited from debiting (black list).

Figure 5:
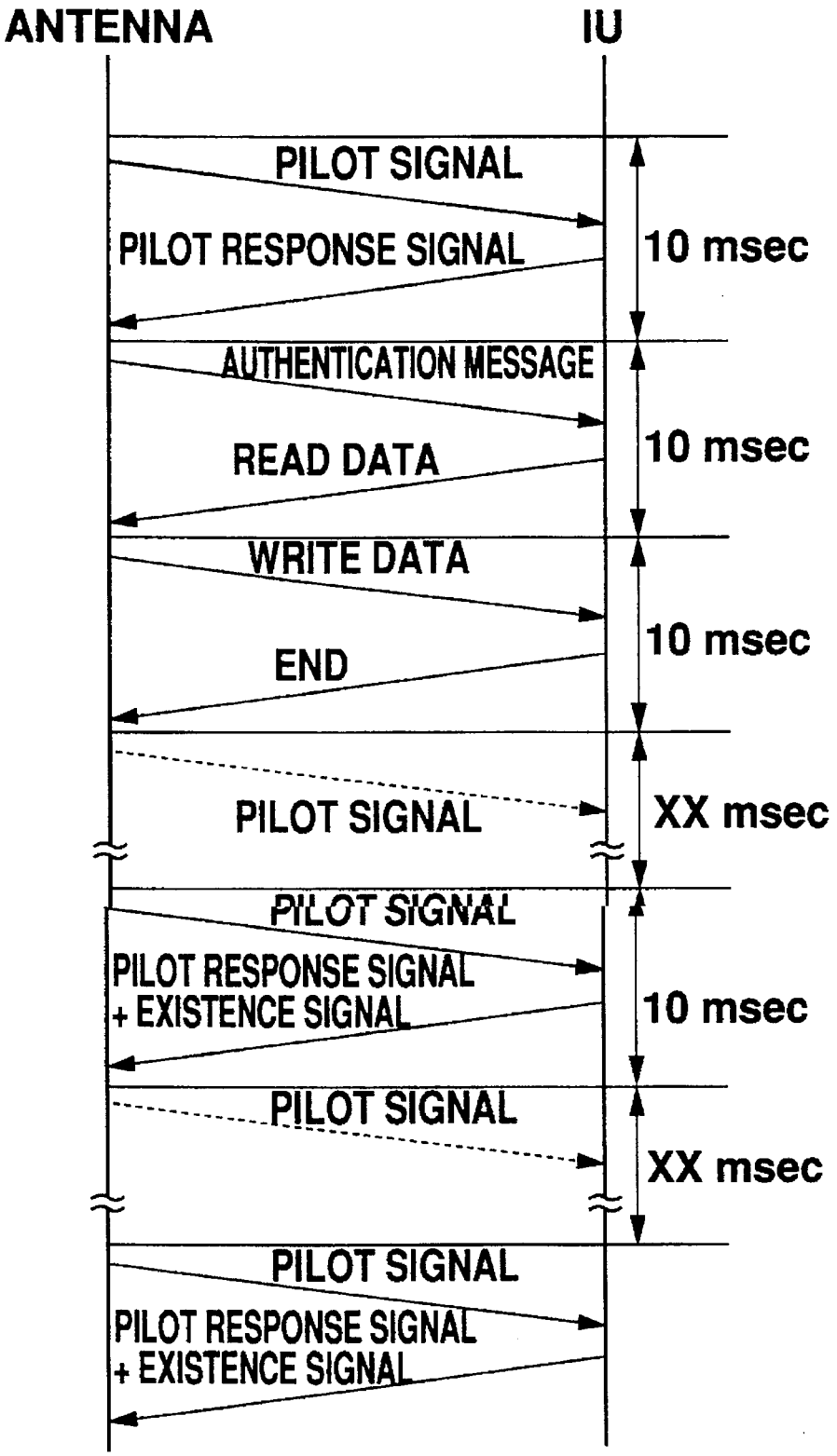
FIG. 5 is a diagram illustrating the procedure of communication in a second gantry communication zone.

As the debited vehicle 16 arrives at the communication zone covered by the confirmation antennas 22 ("second gantry communication zone" shown in FIG. 2), the radio communication is executed between the IU 18 of that vehicle 16 and the local controller 20 through the corresponding confirmation antenna 22 according to the procedure shown in FIG. 5. As will be apparent from FIG. 5, the local controller 20 executes the communication with the IU 18 through the confirmation antenna 22 in a manner similar to that of the debiting procedure. However, since it is not required to deduct the fee from the smart card 36, unlike the debiting procedure, the write data transmitted from the confirmation antenna 22 does not contain the fee information, but is only a signal indicating the termination of the debiting process. The balance is displayed in the confirmed vehicle 16. More particularly, the reader/writer 28 of that vehicle 16 displays the balance on the basis of the balance information in the smart card 36. This may be viewed by the driver of that vehicle. The internal data base of the local controller 20 stores the result of debiting confirmation and times at which the signals from the IU 18 were received by the local controller 20.

Even after the confirmation of debiting has been terminated, the local controller 20 transmits the pilot signal in a given repeat cycle. The IU's 18 will not response to the pilot signal from the confirmation antennas 22 for a while. This no-answer period (=XX msec.) is selected so that when the vehicle 16 gets out of the communication zone covered by the confirmation antennas 22 smoothly (i.e. without stopping rapid and without abnormal acceleration or deceleration), the IU 18 of that vehicle 16 will not need to response to any pilot signal from the confirmation antennas 22 on the second gantry 12. Even when a given time period XX msec. (e.g., 300 msec.) has passed if an IU 18 can still receive the pilot signal from the corresponding confirmation antenna 22 after the confirmation of debiting has been terminated, the IU 18 transmits the pilot response signal to answer the pilot signal. However, the pilot response signal transmitted at this time now contains an additional existence-in-second-gantry-zone signal having contents to distinguish this pilot response signal from that following the confirmation of debiting. The local controller 20 receives the pilot response signal containing the additional existence-in-second-gantry-zone signal to ascertain that the debited vehicle 16 exists in the communication zone covered by the confirmation antenna 22. The internal data base of the local controller 20 then stores the time of reception of this signal.

The local controller 20 detects the passage of vehicles 16 through the vehicle detectors 26 with the time thereof. In response thereto, the local controller 20 writes this information in its internal data base on one hand and controls the enforcement cameras 24 to capture the license plates of the vehicles 16 on the other hand. The capture of license plates may be carried out for all the vehicles 16 without any conditions being applied, or may only be performed for a vehicle 16 in which any illegality or discrepancy is found as a result of a validity or black list search, or for a vehicle 16 in which any discrepancy is found on the confirmation of debiting. In conjunction with the images of the license plate the local controller 20 executes correlation mapping to correlate a vehicle in which the debiting or the confirmation of debiting was not properly made with a vehicle having its license plate captured. Information relating to the license plate image of a vehicle 16 and specifying that its debiting or confirmation of debiting was not properly carried out for example is transmitted from the local controller 20 to the host controller as part of the transaction report.

Figure 6:
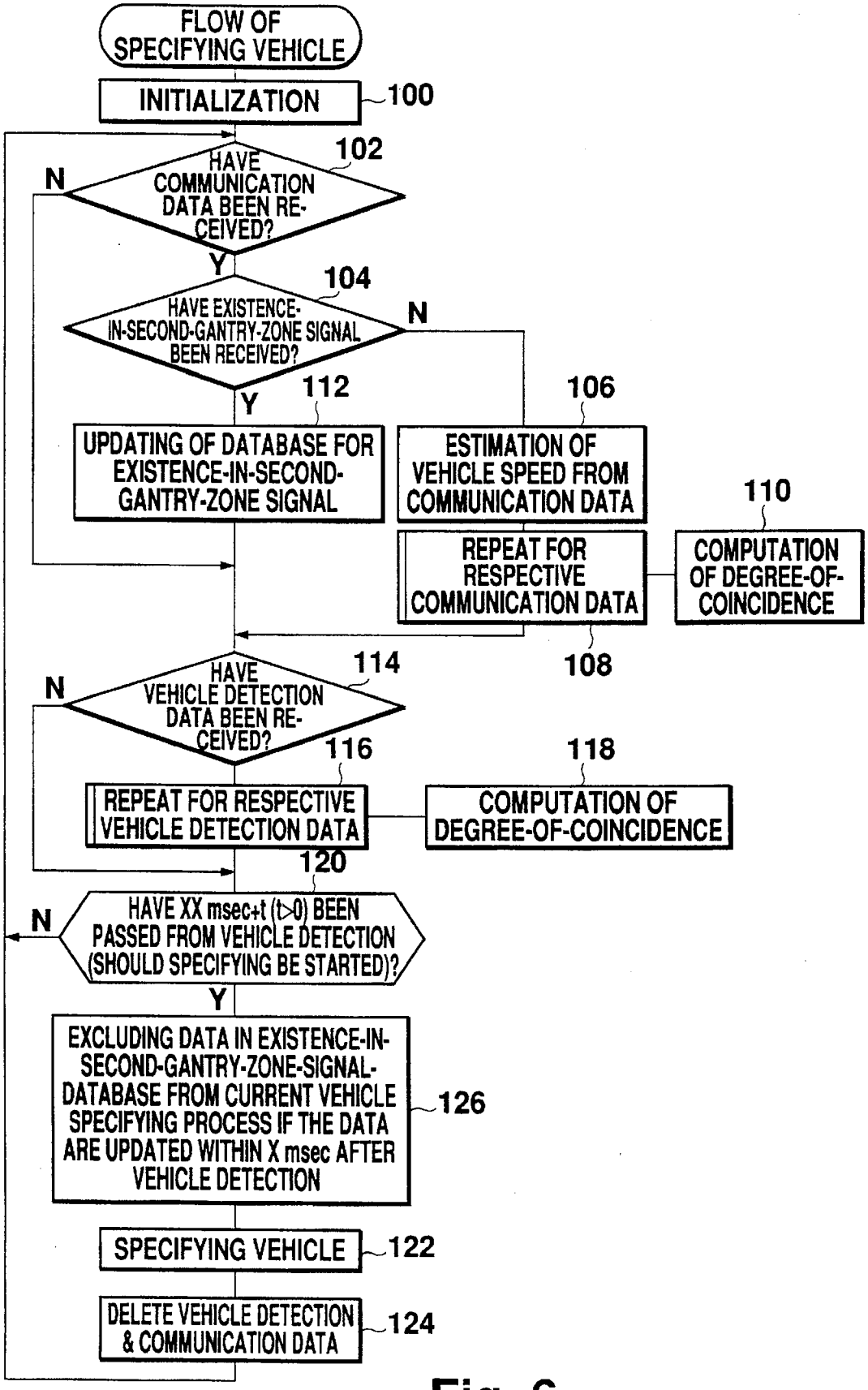
FIG. 6 is a flowchart illustrating the flow of a preprocess of a correlation mapping.

One of the features of the first embodiment resides in the fact that when a vehicle is to be specified by the correlation mapping, a vehicle 16 still existing in the communication zone covered by the confirmation antennas 22, in spite of the fact that this vehicle has been terminated in the confirmation of debiting, can be excluded as a result of its existence-in-second-gantry-zone signal being received. FIG. 6 shows the process in the local controller 20 relating to this procedure. While not shown, it is now assumed that the times of reception of the signals from the IU's 18 through the debiting antennas 14 in the debiting procedure have been stored in the internal data base of the local controller 20.

The local controller 20 first executes a given initialization (100). As the local controller 20 receives a signal (communication data) from any one of the IU's 18 through any one of the confirmation antennas 22 (102), the local controller 20 stores the received communication data in its internal data base and judges whether or not this communication data contains an existence-in-second-gantry-zone signal (104). If it is judged that the communication data does not contain the existence-in-second-gantry-zone the local controller 20 estimates the speed of the vehicle 16 from a time of reception of the communication data already obtained on the debiting procedure and a time of reception of the communication data now obtained for confirmation of debiting (106). The local controller 20 subsequently computes a degree-of-coincidence (110) for each of the vehicles 16 passing below the second gantry 12 (108), according to a given algorithm and on the basis of the estimated speed. If it is judged that the communication data contains the existence-in-second-gantry-zone signal, the local controller 20 registers the time of reception in the internal data base (112).

As a time point when information relating to the license plate image (vehicle detection data) is obtained through the vehicle detectors 26 and enforcement cameras 24 and then stored in the internal data base of the local controller 20 (114), the local controller 20 computes a degree-of-coincidence (118) relating to each of the vehicles 16 passing below the second gantry 12 (116) on the basis of a time period from the reception of the communication for confirmation of debiting to the detection of vehicle passage by the vehicle detectors 26 and according to a given algorithm. After the passage of at least one vehicle 16 is detected by the vehicle detectors 26 and a given time period (XX+t) msec. (where t is a margin time period larger than zero) has passed (120), the local controller 20 uses, as indices, the degree-of-coincidence computed at the step 110, as well as the degree-of-coincidence computed at the step 118 to execute the vehicle specifying operation (correlation mapping). That is, a process of correlating a vehicle 16 detected by the vehicle detectors 26 with a vehicle 16 that has transmitted communication data which has been received by the confirmation antennas 22 prior to the detection of the first-mentioned vehicle 16 (122) is executed. After a vehicle has been specified, the local controller 20 deletes the communication and vehicle detection data relating to the specified vehicle from its data base (124).

In the first embodiment, an exclusion process (126) is executed after the step 120 and before the step 122. More particularly, since, among the existence-in-second-gantry-zone signals having their times of reception stored in the internal data base of the local controller 20 at a time point when the vehicle specifying process is initiated, it is considered that the existence-in-second-gantry-zone signals that are registered again (updated) within the time period XX msec. after detection of the vehicles 16 by the vehicle detectors 26 are those transmitted from other vehicles which have moved past the vehicle detectors 26 after the vehicles 16 have been detected by the vehicle detectors 26, or other vehicles that have not yet passed through the vehicle detectors 26 after the time period XX msec. has elapsed and also after detection of the vehicle 16 by the vehicle detectors 26, they are omitted from the vehicle specifying process at this time. By providing such a function, the vehicles can be more precisely specified with a lower incidence of mis-detection of a proper or improper vehicle, even during a traffic 3am or start-and-stop operation. Further, a procedure of visually specifying the vehicles in the host controller to avoid the risk of such mis-detection can be omitted or made less strict.

FIGS. 7 to 10 show the detailed function and advantage of the first embodiment.

Figure 7:
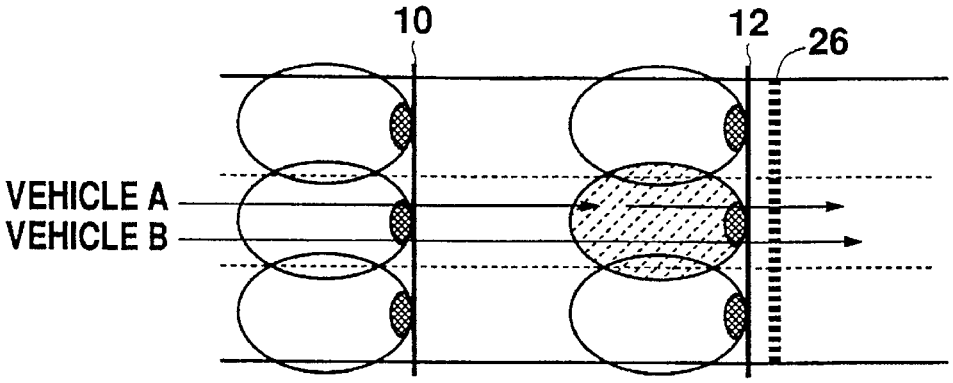
FIG. 7 is a plan view illustrating the function and advantage of the first embodiment.

It is now assumed that two vehicles A and B are now running side by side in the second lane as shown in FIG. 7. It is also assumed that the vehicle A temporarily stops in the communication zone covered by the confirmation antennas 22 and then re-starts and passes through the communication zone. It is further assumed that the vehicle B passes through the communication zone covered by the confirmation antennas 22 without stopping.

Figure 8:
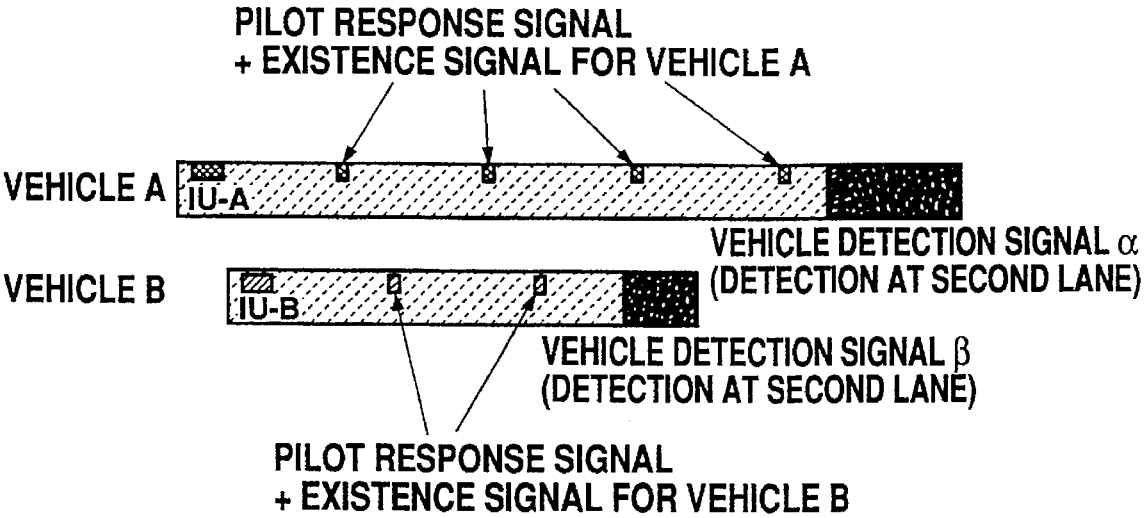
FIG. 8 is a view illustrating timings of a pilot response signal, existence-in-second-gantry-zone signal and vehicle detection signal which are produced in FIG. 7.

In such a case, times of the pilot response signals and existence-in-second-gantry-zone signals transmitted from the IU's 18 on the vehicles A and B (which IU's will be called IU-A and IU-B for distinction) are as shown in FIG. 8. Since the vehicle A stops in the communication zone covered by the confirmation antenna 22 for the second lane as shown, the pilot response signal and existence-in-second-gantry-zone signal from the IU-A will be received by the confirmation antenna 22 even after the passage of the vehicle B has been detected by the vehicle detector 26 for the second lane.

When a vehicle detection signal indicating the detection of vehicle made by the vehicle detector 26 for the second lane is provided at a particular time point, if the pilot response signal and existence-in-second-gantry-zone signal are received by the confirmation antenna 22 for a time period from the occurrence of the above vehicle detection signal to the elapsing of the time period, (XX+t) msec., it is determined that the vehicle detection signal obtained prior to such a reception is not a vehicle detection signal $\alpha$ indicating the vehicle A, but a vehicle detection signal $\beta$ indicating the vehicle B. According to such a principle, the aforementioned process relating to the step 126 discriminates the pilot response signal and existence-in-second-gantry-zone signal from the vehicle A and excludes them from the vehicle specifying process relating to the vehicle B.

Figure 9:
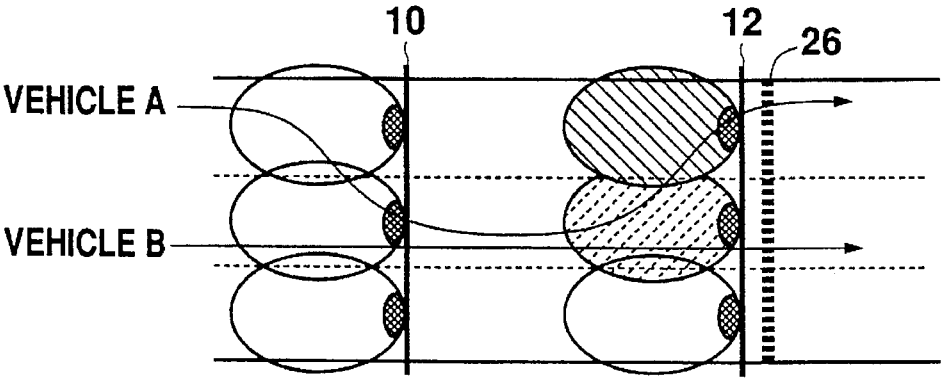
FIG. 9 is a plan view illustrating the function and advantage of the first embodiment.

It is further assumed that as shown in FIG. 9, the vehicle A is initially running in the first lane, enters the communication zone covered by the confirmation antenna 22 for the second lane, further enters the communication zone covered by the confirmation antenna 22 for the first lane and is finally detected by the vehicle detector 26 for the first lane. On the other hand, it is assumed that the vehicle B continues to run in the second lane as in FIG. 7.

Figure 10:
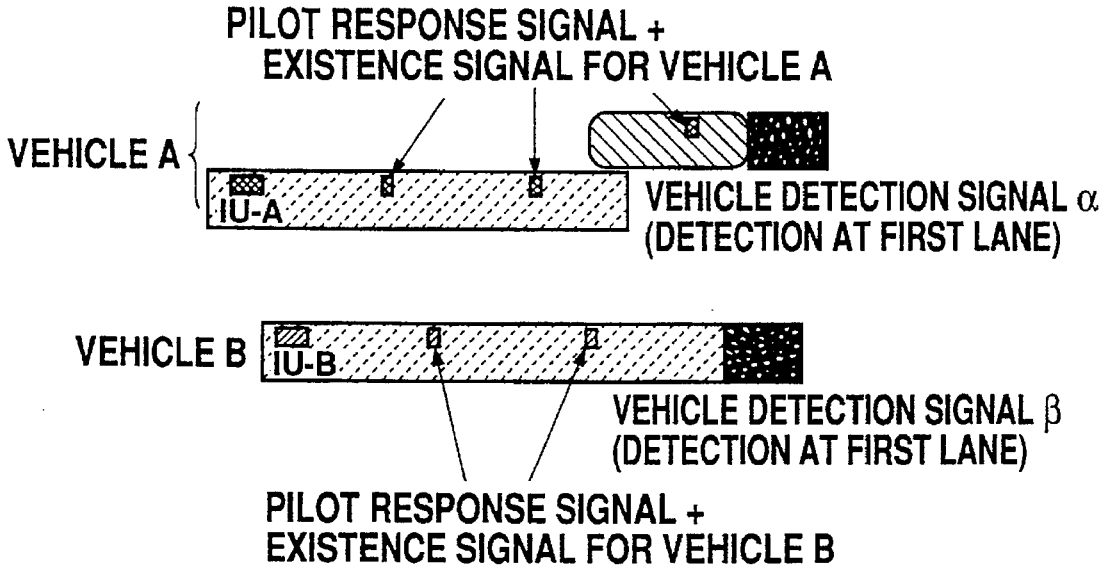
FIG. 10 is a view illustrating timings of a pilot response signal, existence-in-second-gantry-zone signal and vehicle detection signal which are produced in FIG. 9.

In such a situation, times of the pilot response signal and existence-in-second-gantry-zone signal from the IU-A and IU-B on the vehicles A and B are as shown in FIG. 10. More particularly, if a vehicle detection signal is obtained by the vehicle detector 26 within the time period, (XX+t) msec., after the pilot response signal and existence-in-second-gantry-zone signal are received by the confirmation antenna 22 for the first lane, it is understood that this vehicle detection signal is a vehicle detection signal $\alpha$ indicating the detection of the vehicle A.

Figure 11:
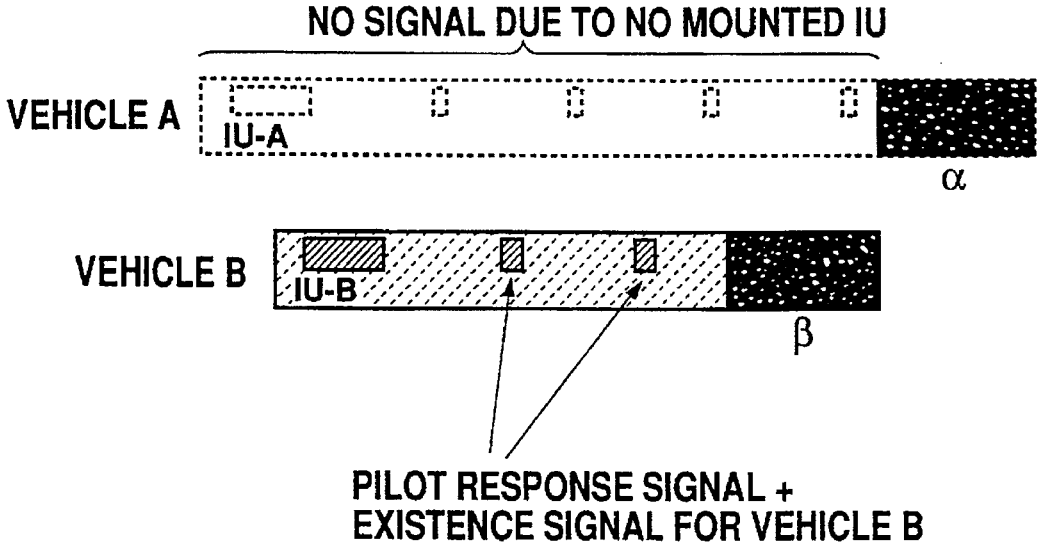
FIG. 11 is a view illustrating timings of a pilot response signal, existence-in-second-gantry-zone signal and vehicle detection signal which are produced if a vehicle A in FIG. 7 does not include an IU.

In the first embodiment, however, it may be difficult to specify the vehicles in a certain situation. It is assumed, for example, that one of the vehicles A and B shown in FIG. 7 (e.g., vehicle A) does not include an IU 18 mounted thereon. In such a case, no communication for debiting and confirmation of debiting is executed, nor any transmission/reception of pilot response signal + existence-in-second-gantry-zone signal to be executed after the confirmation of debiting. As shown in FIG. 11, however, the vehicle detection signal $\alpha$ is produced as in FIG. 8 when the vehicle A passes through the vehicle detector 26. If such a problem is neglected, the amount of license plate images to be contained in the transaction report to the host increases, which increases the burden on the system. A problem will be raised as to in what manner the local controller 20 can ascertain that the vehicle B is indicated by either of the vehicle detection signals $\alpha$ and $\beta$. A similar problem may be raised when the vehicle B shown in FIG. 7 does not include an IU 18 mounted therein or when a plurality of vehicles (any one of which does not have an IU 18) are running side by side in the same lane at different speeds.

To overcome such a problem, there may be considered a method of detecting a vehicle which has not properly performed the communication for the debiting or confirmation of debiting or which has improperly terminated during debiting or confirmation of debiting. For example, a loop coil, line scanner or other vehicle detector (second vehicle detector) may be located at any point on the road extending from adjacent to the communication zone covered by the debiting antennas 14 to upstream of the communication zone covered by the confirmation antennas 22. Thus, the second vehicle detector can ascertain "the existence of a vehicle 26 not properly debited" and "the position of that vehicle 16 on the lane at the point at which the second vehicle detector is positioned", before the vehicle 16 is detected by a vehicle detector 26. By utilizing the vehicle detection signal that is obtained by the vehicle detector 26 and which indicates "the existence of a vehicle 16 separated from the communication zone covered by the confirmation antenna 22" and "the position of that vehicle on the lane at the point at which the vehicle detector 26 is disposed", it can be ascertained with a certain probability whether either of two vehicle detection signals α and β shown in FIG. 11 is "a detection signal of the vehicle not properly debited".

However, such a technique has a disadvantage in that additional installation and maintenance costs are produced since the second vehicle detectors are required. To overcome such a problem, it is preferable that the relative position between the communication zone covered by the confirmation antennas 22 and the vehicle detectors 26 is so set that the vehicle detectors 26 are located within the communication zone covered by the confirmation antennas 22, as shown in FIG. 12 as a second embodiment.

In such an arrangement, first, it may be considered that a vehicle 16 producing a vehicle detection signal at a lane exists within the communication zone covered by the confirmation antenna 22 for that lane. Second, it may be considered that if the cycle of transmission and vehicle detectors 26 are designed such that a period of producing a vehicle detection signal is substantially equal to or longer than the cycle of transmitting the pilot response signal + existence-in-second-gantry-zone signal, a vehicle 16 running in a lane will transmit the pilot response signal + existence-in-second-gantry-zone signal at least once when that vehicle 16 causes a member or part belonging to that lane among the vehicle detectors 26 to be producing the vehicle detection signal. If a confirmation antenna 22 corresponding to a lane receives the pilot response signal + existence-in-second-gantry-zone signal when a vehicle detection signal is being produced at that lane, therefore, it may be considered that a vehicle 16 causing that vehicle detection signal to be produced is coincident with a vehicle 16 transmitting the pilot response signal + existence-in-second-gantry-zone signal.

Figure 12:
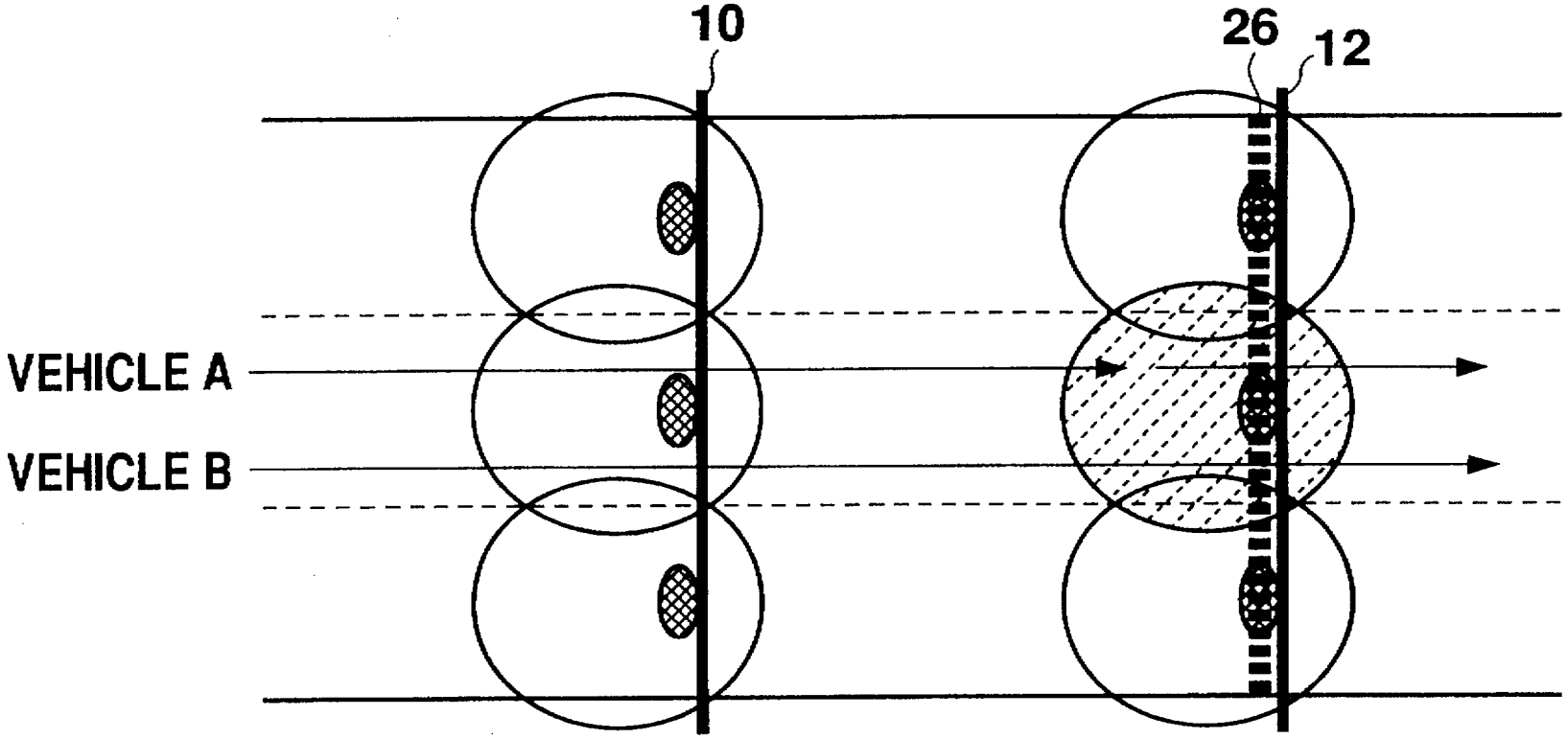
FIG. 12 is a plan view illustrating the positional relationship between the second gantry communication zone and the vehicle detectors in the second embodiment of the present invention.
Figure 13:
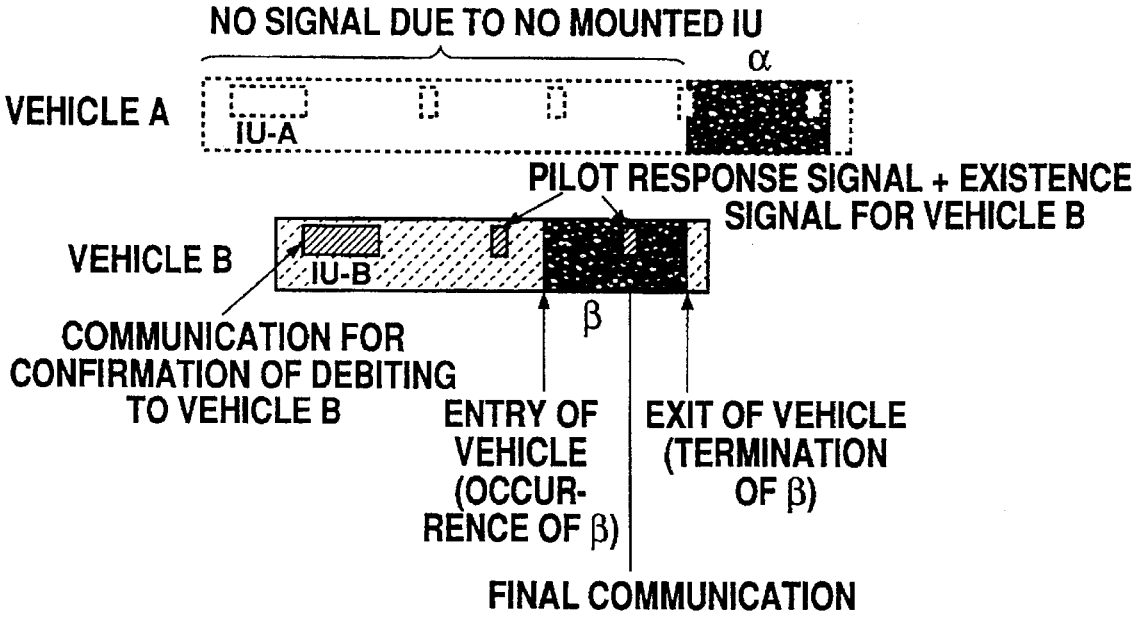
FIG. 13 is a plan view illustrating the function and advantage of the second embodiment.

Even if the vehicles are running in such a manner as shown in FIG. 7 in such an arrangement as shown in FIG. 12 and even when the vehicle A does not have an IU 18, the local controller 20 can correlate the vehicle detection signals α and β with each other and ascertain the fact that the vehicle A is a vehicle not having an IU 18, as shown in FIG. 13. Similar advantages can be obtained even when the other vehicle B does not have an IU 18 or even if a plurality of vehicles are running in the same lane at different speeds with any one of them not having an IU 18.

In consideration of simplicity for system designing and manufacturing (positioning and others), it is particularly preferable that each of the vehicle detectors 26 is disposed directly below the corresponding confirmation antenna 22. It is of course possible to use any other layout. For example, if each of the vehicle detectors 26 is in the form of a loop coil, it may be disposed at a position offset from the corresponding confirmation antenna 22 in consideration of any delay in following a change in the inductance.

Although the embodiment of FIG. 1 has been described as to a six-lane road, the present invention may be similarly applied to any other road having more or less than six lanes.

While there has been described what are at present considered to be preferred embodiments of the invention, it will be understood that various modifications may be made thereto, and it is intended that the appended claims cover all such modifications as fall within the true spirit and scope of the invention.

We claim:

1. A mobile communication method for communicating between a fixed station disposed adjacent to a road on which a plurality of moving bodies are moving and mobile stations respectively installed on the moving bodies, the method comprising:

a first step of repeatedly and wirelessly transmitting a solicitation signal from the fixed station toward a communication zone for soliciting a communication of information between the fixed station and one of said plurality of moving bodies;

a second step of wirelessly transmitting one of a first response signal representing a willingness to participate in the communication of information and a second response signal indicating that information has already been communicated from a mobile station located in the communication zone in response to the solicitation signal, the first response signal being transmitted from a mobile station which has not yet participated in the communication of information, the second response signal being transmitted from a mobile station, which has already participated in the communication of information; and a third step of wirelessly communication information between a fixed station which transmitted the solicitation signal and a mobile station which transmitted the first response signal.

2. A mobile communication method according to claim 1, wherein the second step includes a step of causing any mobile station that previously communicated information with the fixed station from among the mobile stations existing in the communication zone to wirelessly transmit the second response signal in reply to the solicitation signal when a given time period has passed after the communication of information has terminated.

3. A mobile communication method for communicating between a fixed station disposed adjacent to a road on which a plurality of moving bodies are moving and mobile stations respectively installed on the moving bodies, the method comprising:

a first step of repeatedly and wirelessly transmitting a solicitation signal from the fixed station toward a communication zone for soliciting a communication of information between the fixed station and one of said plurality of moving bodies;

a second step of wirelessly transmitting one of a first response signal representing a willingness to participate in the communication of information and a second response signal indicating that information has already been communicated from a mobile station located in the communication zone in response to the solicitation signal, the first response signal being transmitted from a mobile station which has not yet participated in the communication participated in the communication of information, the second response signal being transmitted from a mobile station, which has already participated in the communication of information;

a third step of wirelessly communicating information between a fixed station which transmitted the solicitation signal and a mobile station which transmitted the first response signal;

a fourth step of causing the fixed station to detect times at which the first response signal and the second response signal are received by the fixed station;

a fifth step of causing the fixed station to detect that a moving body has passed through a given point on the road and a time at which this occurs in parallel to the execution of the first to fourth steps; and a sixth step of causing the fixed station to detect a moving body having a mobile station that did not exactly execute the second step from among the moving bodies whose passage is detected in the fifth step by matching the time of reception detected in the fourth step with the time of passage detected in the fifth step.

4. A mobile communication method according to claim 3, wherein the given point is within the communication zone.

5. A mobile communication method for communicating between a fixed station disposed adjacent to a road on which a plurality of moving bodies are moving and mobile stations respectively installed on the moving bodies, the method comprising:

a first step of repeatedly and wirelessly transmitting a solicitation signal from the fixed station toward a communication zone for soliciting a communication of information between the fixed station and one of said plurality of moving bodies;

a second step of wirelessly transmitting one of a first response signal representing a willingness to participate in the communication of information and a second response signal indicating that information has already been communicated from a mobile station located in the communication zone in response to the solicitation signal, the first response signal being transmitted from a mobile station which has not yet participated in the communication participated in the communication of information, the second response signal being transmitted from a mobile station, which has already participated in the communication of information, wherein the second step includes a step of causing any mobile station that previously communicated information with the fixed station from among the mobile stations existing in the communication zone to wirelessly transmit the second response signal in reply to the solicitation signal when a given time period has passed after the communication of information has terminated;

a third step of wirelessly communicating information between a fixed station which transmitted the solicitation signal and a mobile station which transmitted the first response signal;

a fourth step of causing the fixed station to detect timings at which the first response signal and the second response signal are received by the fixed station;

a fifth step of causing the fixed station to detect that a moving body has passed through a give point on the road and a time at which this occurs in parallel to the execution of the first to fourth steps;

a sixth step of causing the fixed station to detect a moving body having a mobile station that does not exactly execute the second step from among the moving bodies whose passage is detected in the fifth step by matching the time of reception detected in the fourth step with the time of passage detected in the fifth step; and a seventh step of, prior to the sixth step, excluding selective response signals of the first response signals and the second response signals from being used to carry out the matching operation in the sixth step, the selective response signals being the first and second response signals whose time of reception have been detected in the fourth step as being not later than the given time period that has been passed after the time of passage detected in the fifth step.

6. A mobile communication method according to claim 5, wherein the selective response signals of the seventh step are first response signals and second response signals whose time of reception have been detected in the fourth step as being not later than the given time period plus a margin time that has been passed after the time of passage detected at the fifth step.

7. A mobile communication method according to claim 5, wherein the given point is within the communication zone.

* * * * *